US005794359A

United States Patent [19]

Jenkins et al.

[11] Patent Number: 5,794,359

[45] Date of Patent: Aug. 18, 1998

[54] SOLE AND HEEL STRUCTURE WITH PERIPHERAL FLUID FILLED POCKETS

[75] Inventors: Stuart E. Jenkins, Thousand Oaks; K. Michael Schmidt, deceased, late of Woodside, both of Calif., by Barbara A. Schmidt, legal representative; Tuan N. Le, Portland, Oreg.

[73] Assignee: Energaire Corporation, Pebble Beach, Calif.

[21] Appl. No.: 680,047

[22] Filed: Jul. 15, 1996

[51] Int. Cl.[6] ..... A43B 13/20

[52] U.S. Cl. ..... 36/28; 36/29

[58] Field of Search ..... 36/28, 29, 25 R, 36/153, 154, 3 R, 3 B

[56] References Cited

U.S. PATENT DOCUMENTS

| | | | |
|---|---|---|---|
| D. 287,662 | 1/1987 | Tonkel . | |
| 510,504 | 12/1893 | Foster . | |
| 1,193,608 | 8/1916 | Poulson . | |
| 1,605,985 | 11/1926 | Rasmussen . | |
| 1,639,381 | 8/1927 | Manelas . | |
| 1,676,162 | 7/1928 | Schiller . | |
| 1,819,565 | 8/1931 | McBride . | |
| 2,430,466 | 11/1947 | Hedman . | |
| 2,597,393 | 5/1952 | Slampa . | |
| 2,600,957 | 6/1952 | Bartis . | |
| 2,627,676 | 2/1953 | Hack | 36/29 |
| 2,814,133 | 11/1957 | Herbst . | |
| 4,263,728 | 4/1981 | Frecentese . | |
| 4,297,797 | 11/1981 | Meyers . | |
| 4,358,902 | 11/1982 | Cole et al. . | |
| 4,361,969 | 12/1982 | Vermonet . | |
| 4,372,058 | 2/1983 | Stubblefield . | |
| 4,397,104 | 8/1983 | Doak . | |
| 4,458,430 | 7/1984 | Peterson . | |
| 4,547,978 | 10/1985 | Radford | 36/29 |
| 4,577,417 | 3/1986 | Cole | 36/29 |
| 4,744,157 | 5/1988 | Dubner . | |
| 4,763,426 | 8/1988 | Polus et al. . | |
| 4,782,603 | 11/1988 | Brown . | |
| 4,817,304 | 4/1989 | Parker et al. . | |
| 4,852,274 | 8/1989 | Wilson . | |
| 4,995,173 | 2/1991 | Spier . | |
| 5,042,176 | 8/1991 | Rudy . | |
| 5,060,401 | 10/1991 | Whatley . | |
| 5,113,599 | 5/1992 | Cohen et al. . | |
| 5,117,566 | 6/1992 | Lloyd et al. | 36/29 |
| 5,131,174 | 7/1992 | Drew et al. . | |
| 5,155,927 | 10/1992 | Bates et al. . | |
| 5,158,767 | 10/1992 | Cohen et al. . | |
| 5,253,435 | 10/1993 | Auger et al. . | |
| 5,257,470 | 11/1993 | Auger et al. . | |
| 5,313,717 | 5/1994 | Allen et al. . | |
| 5,325,614 | 7/1994 | Rosen . | |
| 5,353,459 | 10/1994 | Potter et al. . | |
| 5,375,346 | 12/1994 | Cole et al. . | |
| 5,416,988 | 5/1995 | Potter et al. . | |
| 5,444,926 | 8/1995 | Allen et al. . | |

FOREIGN PATENT DOCUMENTS

| | | | |
|---|---|---|---|
| 7441 | 3/1907 | United Kingdom . | |
| 9110377 | 7/1991 | WIPO | 36/29 |

*Primary Examiner*—M. D. Patterson
*Attorney, Agent, or Firm*—Emrich & Dithmar

[57] ABSTRACT

A shoe sole and heel construction is provided. The construction includes a structure having an exterior ground-contacting surface, an elongated midsole disposed in the structure above the ground-contacting surface to avoid contact with the ground in use, the midsole having an outer periphery. The structure also includes a first flexible bulge formed therein and projecting from the exterior ground-contacting surface for contact with the ground in use and defining a first pocket, wherein at least a portion of the first pocket extends outwardly beyond the outer periphery of the midsole or imaginary extensions thereof whereby the portion does not underlie the midsole. The construction further includes fluid disposed in the first pocket, whereby at rest a foot in a shoe incorporating the structure is cushioned comfortably on the fluid in the first pocket.

17 Claims, 4 Drawing Sheets

SOLE AND HEEL STRUCTURE WITH PERIPHERAL FLUID FILLED POCKETS

BACKGROUND OF THE INVENTION

1. Field of the Invention

The present invention relates to shoe sole and heel constructions and, in particular, to such constructions with fluid-filled pockets for providing cushioning.

2. Description of the Prior Art

Various types of shoe sole and heel constructions having fluid-containing cavities have heretofore been provided, such constructions being disclosed, for example, in U.S. Pat. Nos. 4,237,625, 4,358,902, 4,577,417, 5,375,346 and 5,416,986.

These patents disclose a molded outer sole and heel member which has downwardly projecting heel and metatarsal bulges molded therein to define cavities and a passageway extending between the cavities. Air or other fluid, at atmospheric pressure, moves back and forth between the cavities through the passageway during movement of a person wearing the shoe.

These prior sole and heel structures have provided cushioning for the user's foot and have also provided forward thrust which facilitates walking or running movements. These bulges are usually disposed inwardly at a given distance from the outer periphery of the ground-contacting surface of the structure and lie completely under a midsole of the shoe. These bulges can tend to produce a lateral instability in the shoe, causing the shoe to tilt laterally inwardly or outwardly in use, resulting in pronation of the wearer's foot. For example, in walking and jogging gaits, wherein the initial shoe strike is at the heel, the initial point of impact is typically at the lateral outer side of the heel, i.e., at the right side of the right heel and the left side of the left heel. Thus, there is a tendency for the fluid in the heel cavity to move from side to side, as well as forwardly toward the metatarsal cavity. Though this instability has been alleviated by providing downwardly projecting stabilizing structures adjacent to the bulges, or by reconfiguring the fluid flow and bulge configurations, shoes incorporating these prior structures do not always provide adequate cushioning or stability for users who tend to strike the ground with a peripheral edge of the structure and/or are heavier.

SUMMARY OF THE INVENTION

It is a general object of the invention to provide an improved shoe sole and heel structure which avoids the disadvantages of prior structures while affording additional structural and operational advantages.

An important feature of the invention is the provision of a shoe sole and heel structure with fluid-filled pockets which is of relatively simple and economical construction.

A still further feature of the invention of a shoe sole and heel structure of the type set forth which has fluid filled cavities at the peripheral edges of the ground-contacting surface of the structure which provide both lateral stability and cushioning.

These and other features of the invention are attained by providing a shoe sole and heel construction. The construction includes a structure having an exterior ground-contacting surface, an elongated midsole disposed in the structure above the ground contacting surface to avoid contact with the ground in use, the midsole having an outer periphery. The structure also includes a first flexible bulge formed therein and projecting from the exterior ground-contacting surface for contact with the ground in use and defining a first pocket, wherein at least a portion of the first pocket extends outwardly beyond the outer periphery of the midsole or imaginary extensions thereof whereby the portion does not underlie the midsole. The construction further includes fluid disposed in the first pocket, whereby at rest a foot in a shoe incorporating the structure is cushioned comfortably on the fluid in the first pocket.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
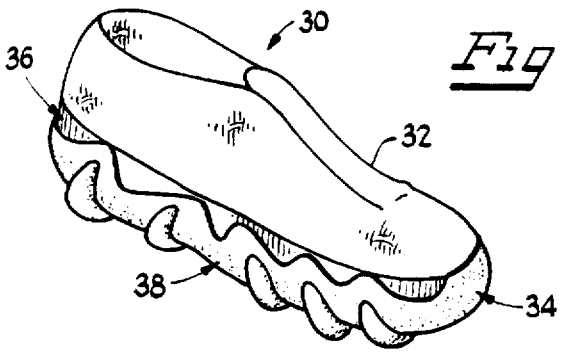
FIG. 1 is a perspective view of a right shoe embodying a sole and heel structure incorporating the features of the present invention.
Figure 2:
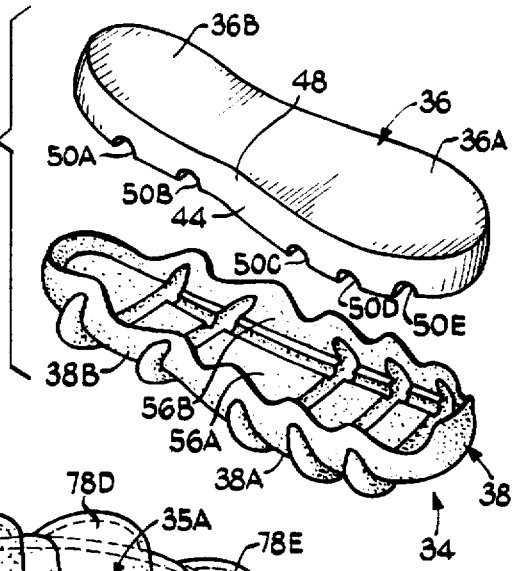
FIG. 2 is an exploded perspective view of the sole and heel structure of FIG. 1.
Figure 5:
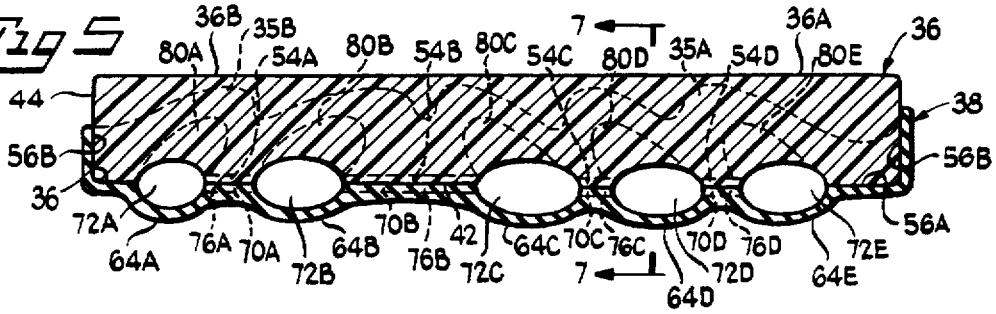
FIG. 5 is a sectional view taken generally along the line 5—5 of FIG. 3.
Figure 6:
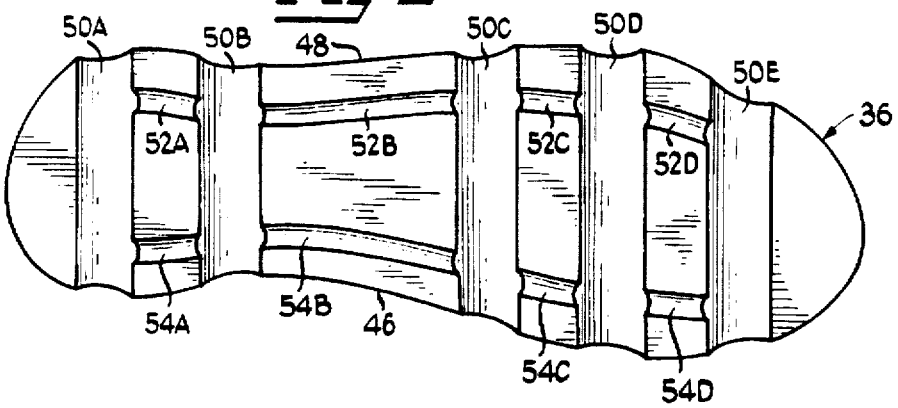
FIG. 6 is a bottom plan view of the midsole of the sole and heel structure of FIG. 3.

As seen in FIGS. 1–7, a shoe 30 having a conventional upper 32 and an outer sole and heel structure 34 is provided. The structure 34 includes a sole portion 35A located generally under the sole of a wearer's foot and a heel portion 35B located generally under the heel of a wearer's foot. The structure 34 includes a midsole 36 overlying at least a portion of an outsole 38. As seen in FIGS. 2 and 5, the midsole 36 is an elongated member which includes a sole portion 36A and a heel portion 36B. The sole portion 36A is located under the sole of a wearer's foot and the heel portion 36B is located under the heel of a wearer's foot. The midsole 36 has a foot facing surface 40 and an outsole facing surface 42. The midsole 36 also has a peripheral side surface 44 defining the outer periphery thereof. The peripheral side surface 44 has a medial side 46 and a lateral side 48. As best seen in FIG. 6, the midsole 36 also has five midsole lateral cavities 50A–E, each opening at the outsole facing surface 42, the medial side 46 and the lateral side 48. The midsole 36 also includes two sets of four smaller channel cavities 52A–D, 54A–D. Each channel cavity 52A–D, 54A–D opens at the outsole facing surface 42 and extends between and opens into two associated midsole lateral cavities 50A–E to fluidly connect all five midsole lateral cavities 50A–E together.

As discussed in greater detail below, the midsole 36 may be a molded piece made of a light-weight, generally non-porous material which prevents the transmission of fluids, such as air, therethrough. Useful midsole materials include molded polyurethane and EVA.

The outsole 38 is an elongated, thin member of one-piece molded construction, preferably made of a highly flexible, highly wear-resistant material, such as rubber. A very useful rubber is a rubber sold under the brand name INDY 500 and made by Goodyear Tire and Rubber Company.

Figure 3:
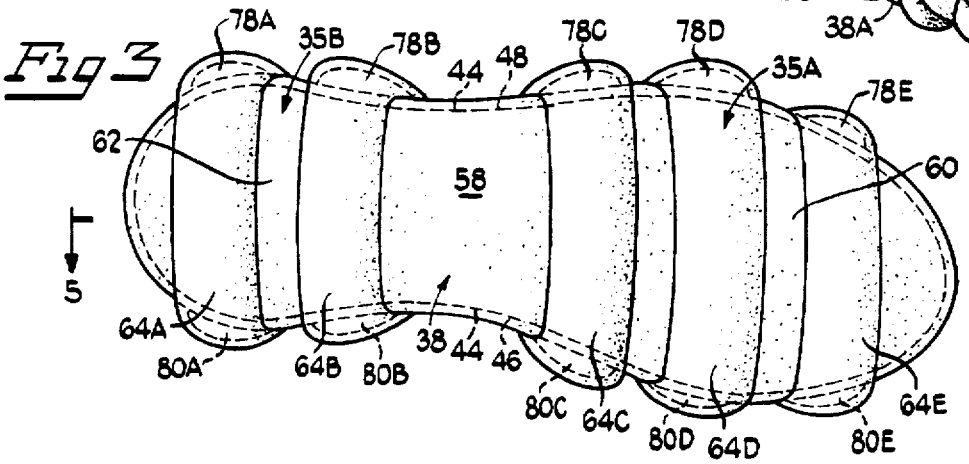
FIG. 3 is an enlarged, bottom plan view of the sole and heel structure of FIG. 1.
Figure 4:
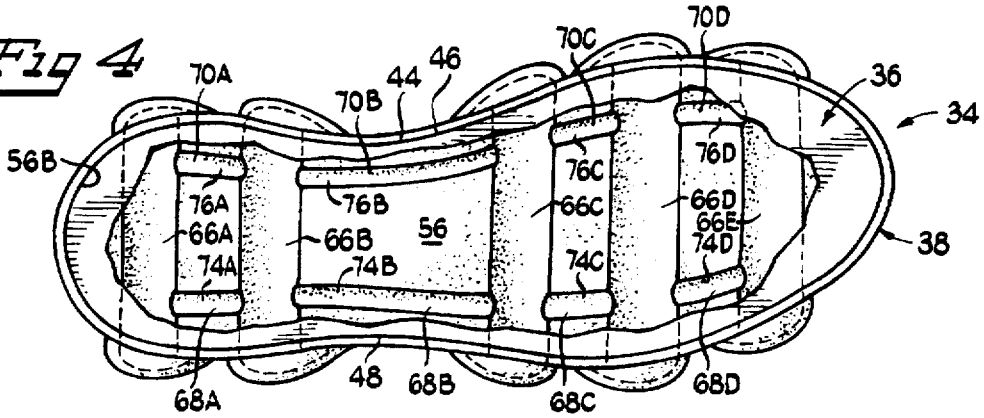
FIG. 4 is a top plan view of the sole and heel structure of FIG. 3 with the midsole shown in phantom.

The outsole 38 has an interior surface 56 which includes a bottom interior surface portion 56A which faces the outsole facing surface 42 of the midsole 36 and a peripheral interior surface portion 56B which faces the peripheral side surface 44 of the midsole 36. The outsole 38, as seen in FIG. 3, also has an exterior surface 58 which is subject to engagement with the pavement or other underlying support surface, which will hereinafter be referred to as the "ground". The outsole 38 also has a sole portion 60 located under the sole portion 36A of the midsole 36 and the sole of a wearer's foot and a heel portion 62 located under the heel portion 36B of the midsole 36 and the heel of the wearer's foot.

Five bulges 64A–E are molded into the outsole 38. Each bulge 64A–E projects downwardly and outwardly from the exterior surface 58 and defines a respective outsole lateral cavity 66A–E. Each outsole lateral cavity 66A–C has a central portion which opens at the bottom interior surface portion 56A and two end portions which open at the peripheral interior surface portion 56B. The central portion of each outsole lateral cavity 66A–E which opens at the bottom interior surface portion 56A is disposed directly under the central portion of a respective midsole lateral cavity 50A–E.

Two sets of four channel cavities 68A–D, 70A–D are also molded into the outsole 38. Each channel cavity 68A–D, 70A–D opens at the interior surface 56 and extends between and opens into two associated adjacent lateral cavities 64A–E to fluidly connect all five lateral cavities 64A–E together. Each of the outsole channel cavities 68A–D is respectively disposed directly under a midsole channel cavity 52A–D. Likewise, each of the outsole channel cavities 7OA–D is respectively disposed directly under a midsole channel cavities 54A–D.

An adhesive is disposed between the interior surface 56 of the outsole 38 and the outsole facing surface 42 of the midsole 36 and between the interior surface 56 and the peripheral side surface 44 for fixedly securing the midsole 36 and outsole 38 together in a fluid-tight manner. In this regard, as discussed above, it will be appreciated that the midsole 36 and the outsole 38 are formed of fluid-impermeable materials and are also resilient to accommodate flexing during use of the shoe 30. Thus, midsole 36 and the outsole 38 cooperate to hermetically seal and form five pockets 72A–E and two sets of four restricted passageways 74A–D and 76A–D, permanently trapping air or other fluid at atmospheric or other pressure therein.

Each of the pockets 72A–E is respectively defined by a midsole lateral cavity 50A–E, the associated outsole lateral cavity 66A–E which it faces, and portions of the peripheral side surface 44 facing the end portions of the associated outsole lateral cavity 66A–E. Pockets 72A and 72B are located in the heel portion 35B and pockets 72C, 72D and 72E and located in the sole portion 35A.

Figure 7:
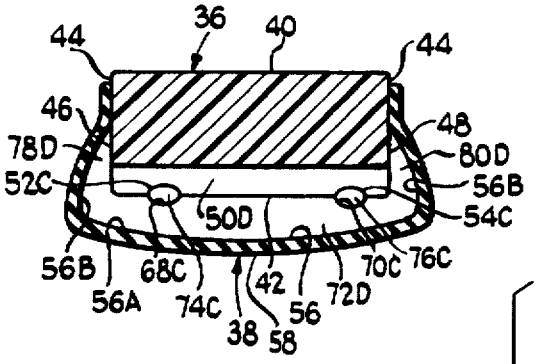
FIG. 7 is a sectional view taken generally along the line 7—7 of FIG. 5.

It is a significant aspect of the present invention that at least some of the pockets 72A–E have portions that extend beyond the outer periphery of peripheral side surface 44 of the midsole 36. As best seen in FIGS. 3, 5 and 7, each of the pockets 72A–E respectively has a lateral portion 78A–E that extends laterally outwardly beyond the lateral side 48 of the peripheral side surface 44 and a medial portion 80A–E that extends laterally outwardly beyond the medial side 46 of the peripheral side surface 44.

Each of the restricted passageways 74A–D is defined by a midsole channel cavity 52A–D and the associated outsole channel cavity 68A–D it overlies. Likewise, each of the restricted passageways 76A–D is defined by a midsole channel cavity 54A–D and the associated outsole channel cavity 70A–D it overlies.

In use, the bulges 64A–E engage the ground when the wearer of the shoe 30 is standing. The fluid in the pockets 72A–E provide a cushioning effect. In walking or running, it is believed that the rolling outwardly of the shoe 30, or pronation, is prevented because the portion of bulges 64A–B forming the lateral portions 78A–B of pockets 72A–B first contact the ground to cushion the initial strike. The initial strike compresses and forces the fluid in lateral portions 78A–B to both move laterally toward the medial portions 80A–B of pockets 72A and 72B and forwardly through passageways 74A–D to the pockets 72C, 72D and 72E. As the wearer's heel naturally rolls over toward the medial side 46 of the midsole 36 the fluid in the medial portions 80A–80B aid in preventing the heel from rolling too far to aid in preventing supination. The force of the wearer's heel also causes further fluid to be sent to the forward pockets 72C–E. As the heel portion 35B lifts off the ground, the air returns to pockets 72A and 72B to give a lifting effect.

In walking and running, the air alternates between pockets 72C–E in the sole portion 35A and pockets 72A and B in the heel portion 35B to give an alternate lifting effect and to allow the pockets 72A and 72B to provide lateral stability, as described above.

Figure 8:
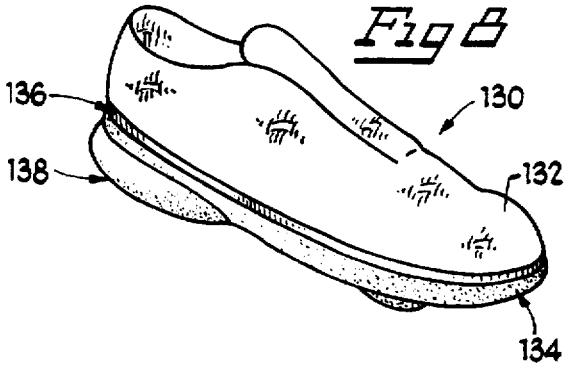
FIG. 8 is a view similar to FIG. 1 of a left shoe incorporating a sole and heel structure in accordance with another embodiment of the present invention.
Figure 9:
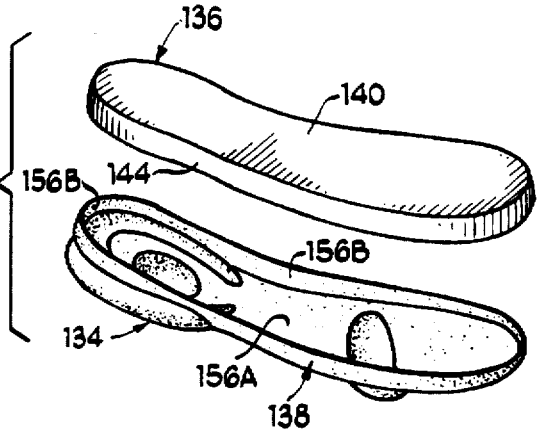
FIG. 9 is an exploded, perspective view of the sole and heel structure of FIG. 8.
Figure 10:
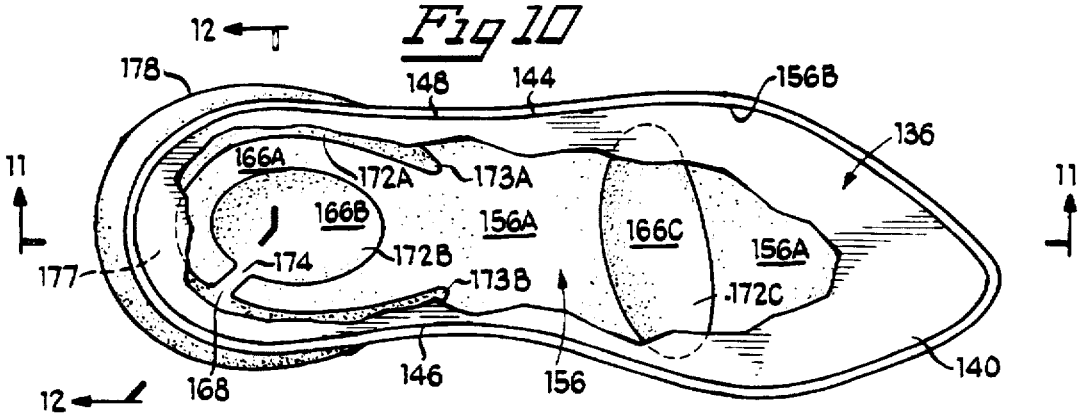
FIG. 10 is an enlarged, top plan view of the structure of FIG. 9 with the midsole shown in phantom.
Figure 11:
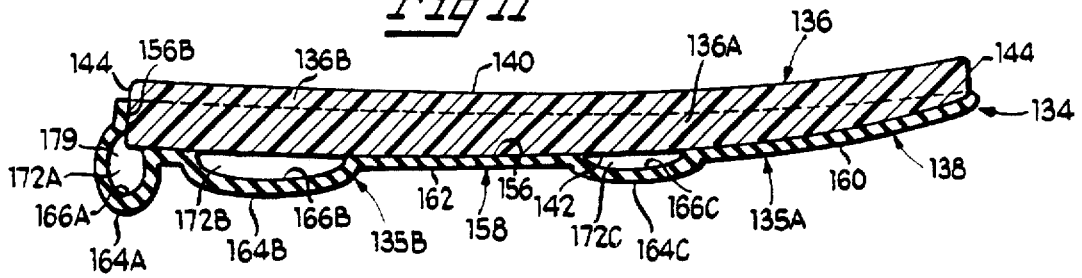
FIG. 11 is a sectional view taken generally along the line 11—11 of FIG. 10.

Referring to FIGS. 8–13, a second embodiment is illustrated. A shoe 130 having a conventional upper or last 132 and an outer sole and heel structure 134 is provided. The structure 134 includes a sole portion 135A located generally under the sole of a wearer's foot and a heel portion 135B located generally under the heel of a wearer's foot. The structure 134 includes a midsole 136 overlying at least a portion of an outsole 138. As seen in FIGS. 8 and 11, the midsole 136 is an elongated member which includes a sole portion 136A and a heel portion 136B. The sole portion 136A is located under the sole of a wearer's foot and the heel portion 136B is located under the heel of a wearer's foot. The midsole 136 has a foot facing surface 140 and a substantially continuous outsole facing surface 142. The midsole 136 also has a peripheral side surface 144 defining the outer periphery thereof. The peripheral side surface 144 has a medial side 146 and a lateral side 148.

The midsole 136 may be made of the same materials as the midsole 36 of FIGS. 1–7.

The outsole 138 is an elongated, thin member of one-piece molded construction, preferably made of the same material as the outsole 38 of FIGS. 1–7.

The outsole 138 has an interior surface 156 which includes a bottom interior surface portion 156A which faces the outsole facing surface 142 of the midsole 136 and a peripheral interior surface portion 156B which faces the peripheral side surface 144 of the midsole 136. The outsole 138 also has an exterior surface 158 which is subject to engagement with the ground. The outsole 138 also has a sole portion 160 located under the sole portion 136A of the midsole 136 and the sole of a wearer's foot and a heel portion 162 located under the heel portion 136B of the midsole 136 and the heel of the wearer's foot.

Three bulges 164A–C are molded into the outsole 138. Bulges 164A and 164B are disposed in the heel portion 162 and bulge 164C is disposed in the sole portion 160. Each bulge 164A–C projects downwardly and outwardly from the exterior surface 158 and defines a respective outsole cavity 166A–C. Outsole cavity 166A is U-shaped and has a peripheral portion which opens at the peripheral interior surface portion 156B. Bulge 164A projects a greater distance downwardly from the exterior surface 158 than either bulge 164B or bulge 164C (FIG. 11).

A channel cavity 168 is also molded into the outsole 138. The channel cavity 168 opens at the bottom interior surface portion 156A and extends between and opens into cavities 166A and 166B to fluidly connect them together. Cavity 166C is oval-shaped and disposed entirely under the midsole 136 between the lateral and medial sides, 148 and 146, of the peripheral side surface 144.

An adhesive is disposed between the bottom interior surface portion 156A of the outsole 138 and the outsole facing surface 142 of the midsole 136 and between the peripheral interior surface portion 156B and the peripheral side surface 144 for fixedly securing the midsole 136 and outsole 138 together in a fluid-tight manner. In this regard, the midsole 136 and the outsole 138 cooperate to hermetically seal and form three pockets 172A–C and a restricted passageway 174 permanently trapping air or other fluid at atmospheric or other pressure therein.

Pocket 172A is U-shaped and defined by outsole cavity 166A, the portion of the peripheral side surface 144 it faces and the portion of the outsole facing surface 142 disposed above the outsole cavity 166A. Pockets 172B and 172C are respectively defined by cavities 166B and 166C and the portion of the outsole facing surface 142 disposed there-above. Pockets 172A and 172B are located in the heel portion 135B and pocket 172C is located in the sole portion 135A generally below the metatarsal ball area of a wearer's foot. Pocket 172A also has first and second ends 173A and 173B longitudinally disposed closer to pocket 172C than any portion of pocket 172B.

Figure 12:
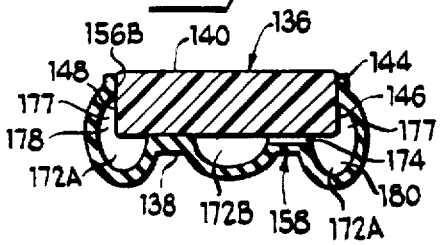
FIG. 12 is a sectional view taken generally along line 12—12 of FIG. 10.
Figure 13:
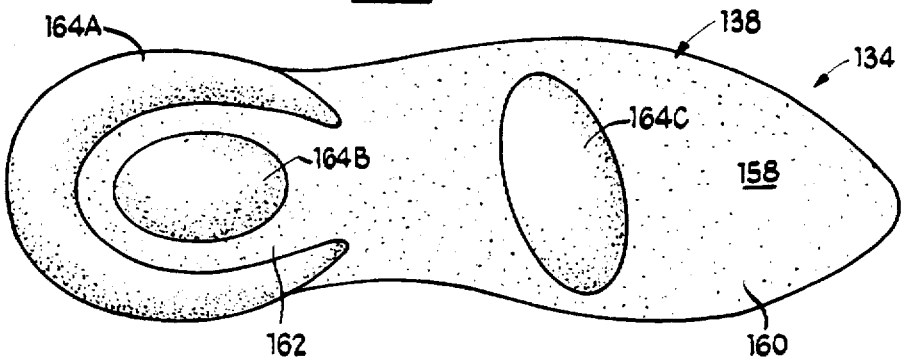
FIG. 13 is a bottom plan view of the sole and heel structure of FIG. 10.
Figure 14:
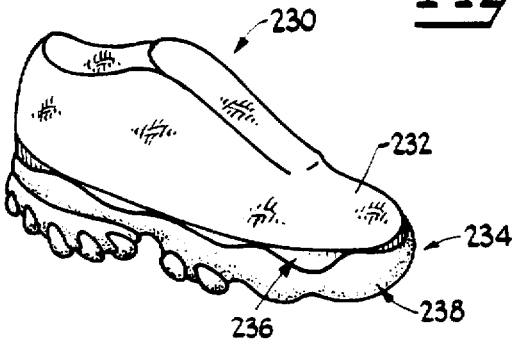
FIG. 14 is a view similar to FIG. 1 of a shoe incorporating a sole and heel structure in accordance with a third embodiment of the present invention.

It is a significant aspect of the present invention that pocket 172A has portions that extend beyond the outer periphery of peripheral side surface 144 of the midsole 136. As best seen in FIGS. 10, 11 and 12, pocket 172A has a U-shaped portion 177 that extends beyond the peripheral side surface 144 of the rear of the structure 134. The U-shaped portion 177 includes a lateral portion 178 that extends laterally outwardly beyond the lateral side 148 of the peripheral side surface 144 and a medial portion 180 that extends laterally outwardly beyond the medial side 146 of the peripheral side surface 144 and a longitudinal portion 179 that extends beyond the rear edge of the midsole 136.

Restricted passageway 174 is defined by outsole channel cavity 168 and the portion of the outsole facing surface 142 overlying it.

In use, pockets 172A, 172B, 172C engage the ground when the wearer of the shoe 130 is standing. The fluid in the pockets 172A–C provides a cushioning effect. In walking or running, the portion of bulge 164A forming the rear of the lateral portion 178 of pocket 172A first strikes the ground. This strike causes the fluid to move forwardly through U-shaped portion 177 toward the first end 173A of the pocket 172A and laterally through longitudinal portion 179 and medial portion 180 toward both the second end 173B and through restricted passageway 174 into pocket 172B. It is believed that after the initial strike, the pressurized fluid in the lateral portion 178 by the first end 173A aids in preventing lateral tilting or pronation of the wearer's heel and foot. As the heel naturally rolls over toward the medial side 148 of the midsole 136, the pressurized fluid in pocket 172B provides proper cushioning to the heel and the pressurized fluid in the medial portion 180 prevents the heel from rolling too far and aids in preventing supination.

As the heel portion 135B of the structure 134 lifts off the ground, the air in pocket 172C cushions the wearer's sole. At the same time, a portion of the pressurized fluid in both pocket 172B and in the medial portion 180 of pocket 172A return to the lateral portion 178 of pocket 172A to prepare for another strike.

Though not shown, pockets 172B, 172C may be connected by a restricted passageway to provide an alternate lifting effect. This effect is described in greater detail in U.S. Pat. Nos. 4,237,625, 4,358,902, 4,577,417, 5,375,346 and 5,416,986, the disclosures of which are incorporated herein by reference.

Figure 15:
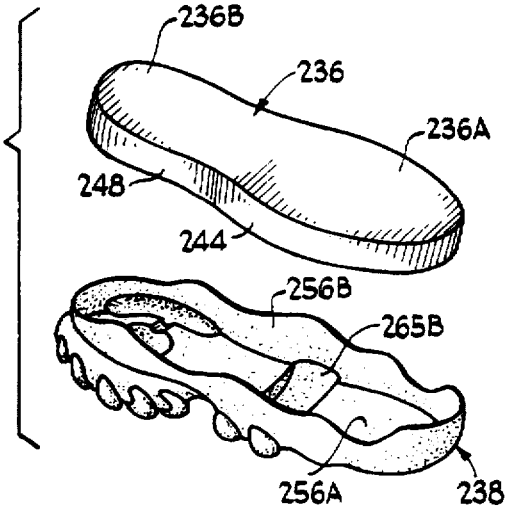
FIG. 15 is an exploded perspective view of the structure of FIG. 14.
Figure 16:
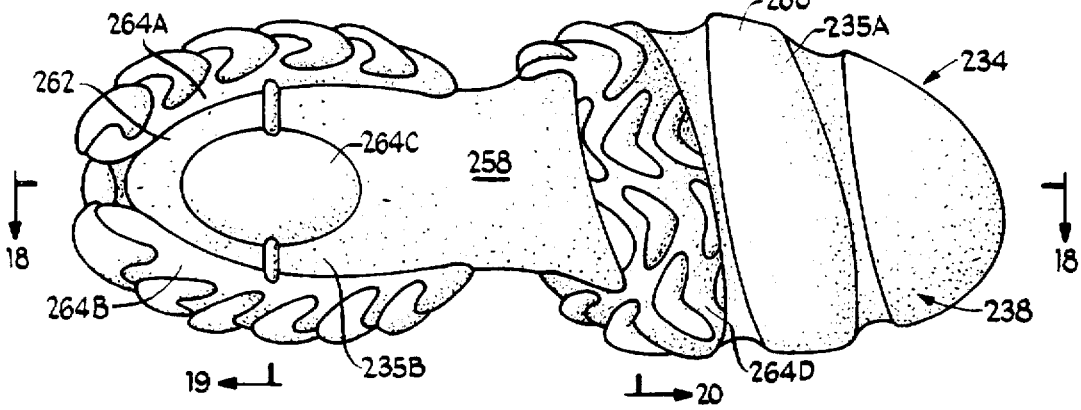
FIG. 16 is an enlarged, bottom plan view of the structure of FIG. 15.
Figure 17:
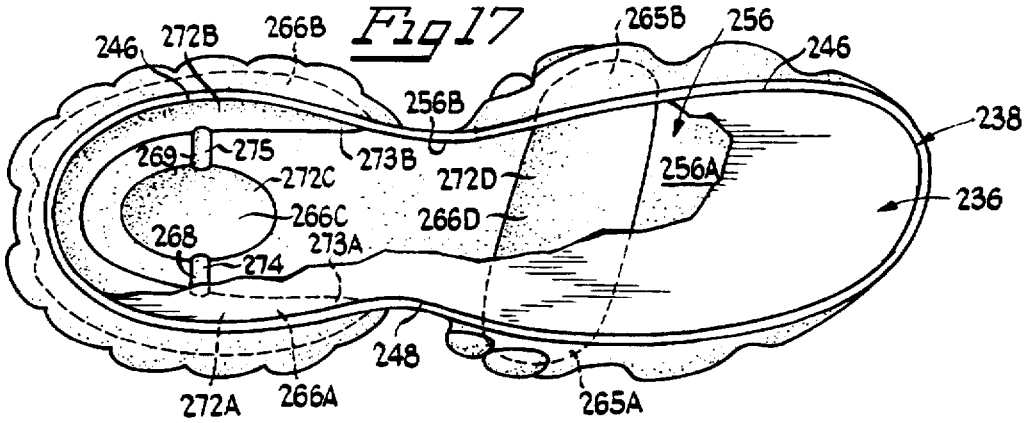
FIG. 17 is a top plan view of the structure of FIG. 16 with the midsole shown in phantom.
Figure 18:
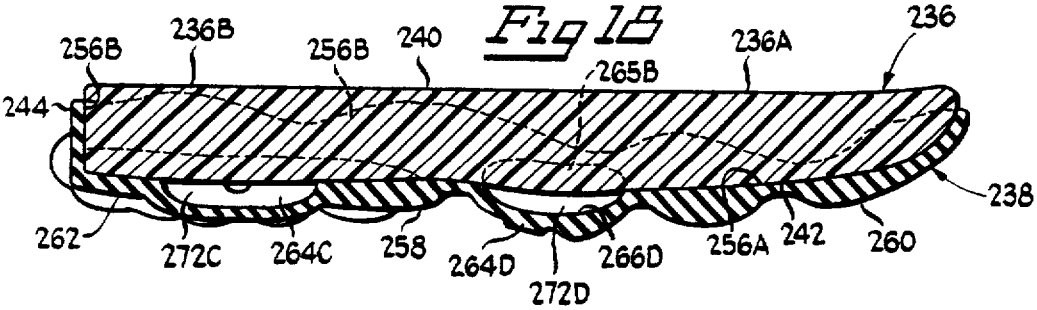
FIG. 18 is a sectional view taken generally along the line 18—18 of FIG. 16.

Referring to FIGS. 14–20, a third embodiment is illustrated. A shoe 230 having a conventional upper or last 232 and an outer sole and heel structure 234 is provided. The structure 234 includes a sole portion 235A located generally under the sole of a wearer's foot and a heel portion 235B located generally under the heel of a wearer's foot. The structure 234 also includes a midsole 236 overlying at least a portion of an outsole 238. As seen in FIGS. 15 and 18, the midsole 236 is an elongated member which includes a sole portion 236A and a heel portion 236B. The sole portion 236A is located under the sole of a wearer's foot and the heel portion 236B is located under the heel of a wearer's foot. The midsole 236 has a foot facing surface 240 and a substantially continuous outsole facing surface 242. The midsole 236 also has a peripheral side surface 244 defining the outer periphery thereof. The peripheral side sur face 244 has a medial side 246 and a lateral side 248.

The midsole 236 may be made of the same materials as the midsoles 36 and 136 of FIGS. 1–13.

The outsole 238 is an elongated, thin member of one-piece molded construction, preferably made of the same material as the outsoles 38 and 138 of FIGS. 1–13.

The outsole 238 has an interior sur face 256 which includes a bottom interior surface portion 256A which faces the outsole facing surface 242 of the midsole 236 and a peripheral interior surface portion 256B which faces the peripheral side surface 244 of the midsole 236. The outsole 238 also has an exterior surface 258 which is subject to engagement with the ground. The outsole 238 also has a sole portion 260 located under the sole portion 236A of the midsole 236 and the sole of a wearer's foot and a heel portion 262 located under the heel portion 236B of the midsole 236 and the heel of the wearer's foot.

Four bulges 264A–D are molded into the outsole 238. Bulges 264A, 264B and 264C are disposed in the heel portion 262 and bulge 264D is disposed in the sole portion 260. Each bulge 264A–D projects downwardly from the exterior surface 258 and defines a respective outsole cavity 266A–D. Each of outsole cavities 266A and 266B is banana-shaped and has a peripheral portion which opens at the peripheral interior surface portion 256B. Cavity 266C is egg-shaped and disposed between cavities 266A and 266B. Bulges 264A and 264B project a greater distance downwardly from the exterior surface 258 than bulge 264C.

Two channel cavities 268, 269 are also molded into the outsole 238 (FIG. 17). The channel cavities 268, 269 opens at the bottom interior surface portion 256A. Channel cavity 268 extends between and opens into cavities 266A and 266C to fluidly connect them together. Likewise, channel cavity 269 extends between and opens into cavities 266B and 266C to fluidly connect them together. Cavity 266D is oval-shaped and disposed generally under the metatarsal ball area of a wearer's foot for which the shoe 230 is sized. Cavity 264D has two peripheral portions 265A, 265B which open at the peripheral interior surface portion 256B and respectively face the lateral side 248 and the medial side 246 of the peripheral side surface 244 of the midsole 236.

An adhesive is disposed between the bottom interior surface portion 256A of the outsole 238 and the outsole facing surface 242 of the midsole 236 and between the peripheral interior surface portion 256B and the peripheral side surface 244 for fixedly securing the midsole 236 and outsole 238 together in a fluid-tight manner. In this regard, the midsole 236 and the outsole 238 cooperate to hermetically seal and form four pockets 272A–D and two restricted passageways 274, 275 permanently trapping air or other fluid at atmospheric or other pressure therein.

Pockets 272A and 272B are each banana-shaped and respectively defined by outsole cavity 266A, 266B, the associated portion of the peripheral side surface 244 therefacing and the associated portion of the outsole facing surface 242 disposed thereabove. Pocket 272C is defined by cavity 266C and the portion of the outsole facing surface 242 disposed thereabove. Pocket 272D is defined by outsole cavity 266D, the portion of the outsole facing surface 242 above outsole cavity 266D, and the portions of the peripheral interior surface portion 256B facing peripheral portions 265A and 265B. Pockets 272A, 272B and 272C are located in the heel portion 235B and pocket 272D is located in the sole portion 235A generally below the metatarsal ball area of a wearer's foot. Pockets 272A and 272B respectively have first ends 273A and 273B (FIG. 17) longitudinally disposed closer to pocket 272D than any portion of pocket 272C.

Figure 19:
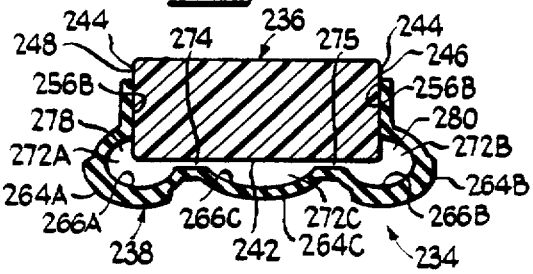
FIG. 19 is a sectional view taken generally along the line 19—19 of FIG. 16.

It is a significant aspect of the present invention that pockets 272A and 272B have portions that extend beyond the outer periphery of peripheral side surface 244 of the midsole 236. As best seen in FIGS. 17 and 19, pocket 272A has a lateral portion 278 that extends laterally outwardly beyond the lateral side 248 of the peripheral side surface 244. Likewise, pocket 272B has a medial portion 280 that extends laterally outwardly beyond the medial side 246 of the peripheral side surface 244 of the midsole 236.

Restricted passageways 274 and 275 are respectively defined by outsole channel cavities 268, 269 and the associated portion of the outsole facing surface 242 overlying each cavity 268, 269.

In use, pockets 272A, 272B, 272C and 272D engage the ground when the wearer of the shoe 230 is standing. The fluid in the pockets 272A–D provides a cushioning effect. In walking or running, the portion of bulge 264A forming the rear of lateral portion 278 of pocket 272A first strikes the ground. This strike causes fluid to move forwardly toward the first end 273A of the pocket 272A and laterally through restricted passageway 274 into pocket 272C. It is believed that after the initial strike, the pressurized fluid in the first end 273A of the pocket 272A aids in preventing lateral tilting or pronation of the wearer's heel and foot. As the wearer's heel naturally rolls over toward the medial side 246 of the midsole 236, the pressurized fluid in pocket 272C provides proper cushioning to the heel and is compressed and forced by the wearer's heel through restricted passageway 275 into pocket 272B which becomes pressurized and prevents the heel from rolling too far and thereby aids in preventing supination.

As the heel portion 235B of the structure 234 lifts off the ground, the air in pocket 272D cushions the wearer's sole. At the same time, a portion of the pressurized fluid in pocket 272B returns to pockets 272A and 272C to prepare for another strike.

Though not shown, pockets 272C and 272D may be connected by a restricted passageway to provide an alternate lifting effect as previously discussed.

Figure 20:
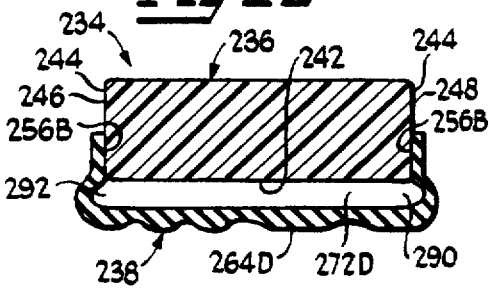
FIG. 20 is a sectional view taken generally along the line 20—20 of FIG. 16.

Additionally, as seen in FIG. 20, pocket 272D has a lateral portion 290 that extends beyond the lateral side 248 of the peripheral side surface 244 and a medial portion 292 that extends beyond the medial side 246 of the peripheral side surface 244. These portions 290, 292 allow pocket 272D to provide proper cushioning to a wearer who strikes the ground with a lateral edge of the sole portion 260 of the outsole 238.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shoe sole and heel construction comprising:

a structure having an exterior ground-contacting surface;

an elongated midsole disposed in the structure above the ground contacting surface to avoid contact with the ground in use, the midsole having a ground facing surface and a peripheral side surface;

a first flexible bulge formed in the structure and projecting from the exterior ground-contacting surface for contact with the ground in use and defining a first pocket, wherein at least a portion of the first pocket extends outwardly beyond the peripheral side surface of the midsole and is defined by the first bulge and a portion of the peripheral side surface so as not to underlie the midsole; and fluid disposed in the first pocket, whereby at rest a foot in a shoe incorporating the structure is cushioned comfortably on the fluid in the first pocket.

2. The construction of claim 1, wherein the midsole has a medial side and a lateral side, wherein a first portion of the first pocket extends laterally beyond one of the lateral or medial sides.

3. The construction of claim 2, wherein the structure includes a heel portion and a sole portion and the first pocket is disposed in the sole portion and underlies the metatarsal ball area of a foot for which the structure is sized.

4. The construction of claim 2, wherein the first portion of the first pocket extends beyond the medial side and a second portion of the first pocket extends beyond the lateral side.

5. The construction of claim 4, wherein a third portion of the first pocket extends longitudinally beyond the periphery of the midsole.

6. The construction of claim 4, wherein the structure includes a heel portion and a sole portion and the first pocket is disposed in the heel portion.

7. The construction of claim 1, and further comprising a second flexible bulge formed in the structure and projecting from the exterior ground-contacting surface for contact with the ground in use and defining a second pocket wherein the fluid is also disposed in the second pocket, whereby the fluid in the second pocket provides cushioning to a foot in a shoe incorporating the structure.

8. The construction of claim 7, and further comprising a passageway providing communication between the first and second pockets, wherein the fluid is permanently disposed in the space jointly defined by the first and second pockets and the passageway, and wherein when force is applied to the first pocket, fluid moves from the first pocket through the passageway to cause the second pocket to be pressurized and when force is removed from the first pocket, the pressurized second pocket forces fluid back into the first pocket, whereby the first and second pockets provide shock absorption to a foot in a shoe incorporating the structure.

9. The construction of claim 8, wherein at least a portion of the second pocket extends outwardly beyond the periphery of the midsole.

10. The construction of claim 7, wherein the structure includes a sole portion and a heel portion and the first flexible bulge and second flexible bulge are disposed in the heel portion, the first flexible bulge projecting a greater distance from the exterior ground contacting surface than the second flexible bulge, whereby in use the first flexible bulge contacts the ground prior to the second flexible bulge when the heel portion first contacts the ground.

11. The construction of claim 10, and further comprising a passageway providing communication between the first and second pockets wherein the fluid is permanently disposed in the space jointly defined by the first and second pockets and the passageway, wherein when force is applied to the first pocket, fluid moves from the first pocket through the passageway to cause the second pocket to be pressurized and when force is removed from the first pocket, the pressurized second pocket forces fluid back into the first pocket, whereby the first and second pockets provide shock absorption to a foot in a shoe incorporating the structure.

12. A sole and heel structure comprising:

an outsole having interior and exterior surfaces and a first bulge projecting from the exterior surface, the first bulge defining a first cavity opening at the interior surface;

an elongated midsole overlying the outsole, the midsole having an outsole-facing surface, a foot-facing surface opposite the outsole-facing surface and a peripheral side surface disposed between the outsole-facing surface and the foot-facing surface;

means for hermetically attaching the interior surface of the outsole to both the outsole-facing surface and the peripheral side surface of the midsole to form a member having a sole portion and a heel portion, wherein the first cavity cooperates with a portion of the midsole to define a first pocket having a first portion disposed directly beneath the outsole-facing surface of the midsole and a second portion that extends outwardly beyond the peripheral side surface; and fluid disposed in the first pocket, whereby at rest a foot in a shoe incorporating the structure is cushioned comfortably on fluid in the first pocket.

13. The structure of claim 12, wherein the outsole includes a second bulge projecting from the exterior surface defining a second cavity opening at the interior surface, wherein the second cavity cooperates with a portion of the midsole to define a second pocket, wherein the fluid is also disposed in the second pocket, whereby the fluid in the second pocket provides cushioning to a foot in the shoe incorporating the structure.

14. A shoe comprising:

a foot-receiving upper and a sole and heel construction secured to the upper;

the construction including:

a structure having an exterior ground-contacting surface;

an elongated midsole disposed in the structure above the ground contacting surface to avoid contact with the ground in use, the midsole having a ground-facing surface and a peripheral side surface;

a first flexible bulge formed in the structure and projecting from the exterior ground-contacting surface for contact with the ground in use and defining a first pocket, wherein at least a portion of the first pocket extends outwardly beyond the peripheral side surface of the midsole and is defined by the first bulge and a portion of the peripheral side surface; and fluid disposed in the first pocket, whereby at rest a foot in a shoe incorporating the structure is cushioned comfortably on the fluid in the first pocket.

15. A sole and heel structure comprising:

an outsole having a lateral extent, interior and exterior surfaces and a first bulge projecting from the exterior surface, the first bulge defining a first cavity opening at the interior surface;

an elongated midsole having a lateral extent less than the lateral extent of the outsole, the midsole overlying the outsole and having an outsole-facing surface, a foot-facing surface opposite the outsole-facing surface, a peripheral side surface disposed between the outsole-facing surface and the foot-facing surface and a second cavity opening at the outsole-facing surface;

means for hermetically attaching the interior surface of the outsole to the midsole to form a member having a sole portion and a heel portion, wherein the first cavity cooperates with a the second cavity to define a first pocket having a first portion disposed directly beneath the outsole-facing surface of the midsole and a second portion that extends outwardly beyond the peripheral side surface; and fluid disposed in the first pocket, whereby at rest a foot in a shoe incorporating the structure is cushioned comfortably on fluid in the first pocket.

16. The sole of claim 15, wherein the second cavity opens at the peripheral side surface.

17. The sole of claim 15, wherein the second portion of the pocket extends above the outsole-facing surface.

* * * * *